US009926650B2

(12) United States Patent
Bocht

(10) Patent No.: US 9,926,650 B2
(45) Date of Patent: Mar. 27, 2018

(54) CLOTHING WIRE FOR A ROLLER OF A CARDING MACHINE

(71) Applicant: Groz-Beckert KG, Albstadt (DE)

(72) Inventor: Bernhard Bocht, Meβstetten (DE)

(73) Assignee: GROZ-BECKERT KG, Albstadt (DE)

( * ) Notice: Subject to any disclaimer, the term of this patent is extended or adjusted under 35 U.S.C. 154(b) by 227 days.

(21) Appl. No.: 14/894,055

(22) PCT Filed: May 27, 2014

(86) PCT No.: PCT/EP2014/060979
§ 371 (c)(1),
(2) Date: Jan. 7, 2016

(87) PCT Pub. No.: WO2014/191422
PCT Pub. Date: Dec. 4, 2014

(65) Prior Publication Data

US 2016/0138201 A1 May 19, 2016

(30) Foreign Application Priority Data

May 27, 2013 (EP) ..... 13169340

(51) Int. Cl.
*D01G 15/88* (2006.01)

(52) U.S. Cl.
CPC ..... *D01G 15/88* (2013.01)

(58) Field of Classification Search
CPC ..... D01G 15/88
(Continued)

(56) References Cited

U.S. PATENT DOCUMENTS 54,619 A * 5/1866 Smith ..... D01G 15/88 19/60
3,231,941 A * 2/1966 Flynn, Jr. ..... D01G 15/48 19/106 R (Continued)

FOREIGN PATENT DOCUMENTS

DE 3940714 A1 6/1991
DE 4038352 A1 6/1992

(Continued)

OTHER PUBLICATIONS

International Search Report for International Application No. PCT/EP2014/060979, dated Jan. 27, 2015, 6 pages.

(Continued)

*Primary Examiner* — Shaun R Hurley
(74) *Attorney, Agent, or Firm* — Fitch, Even, Tabin & Flannery LLP

(57) ABSTRACT

A clothing wire for a clothing roller of a carding machine extends in a wire longitudinal direction and having a base segment, which is thicker transversely to the wire longitudinal direction. A leaf segment, which is narrower compared to the base segment, protrudes from the base segment. A plurality of teeth is formed on the leaf segment along the clothing wire in the wire longitudinal direction. Each tooth has two leaf segment lateral surfaces adjoining the base segment. On at least one of the leaf segment lateral surfaces, at least one projection is formed on each tooth. The cross-sectional profile of the projection is asymmetric and preferably has the contour of a nose. The design of the clothing wire results in a homogenization or parallelization of the fibers, with little wear of the clothing wire and less damage to the fibers.

16 Claims, 7 Drawing Sheets

(58) Field of Classification Search
USPC ..... 19/114; D15/78
See application file for complete search history.

(56) References Cited

U.S. PATENT DOCUMENTS

| | | | | |
|---|---|---|---|---|
| 3,391,429 | A | 7/1968 | Watanabe | |
| 4,169,019 | A * | 9/1979 | Motobayashi | C25D 5/02 19/114 |
| 4,854,012 | A * | 8/1989 | Graf | D01G 15/88 19/114 |
| 5,428,949 | A | 7/1995 | Stahlecker | |
| 6,185,789 | B1 * | 2/2001 | Hollingsworth | D01G 15/24 19/114 |
| 6,920,671 | B2 | 7/2005 | Graf | |
| 2012/0255143 | A1 * | 10/2012 | Iten | D01G 15/88 19/106 R |
| 2013/0042437 | A1 * | 2/2013 | Vangheluwe | D01G 15/88 19/114 |

FOREIGN PATENT DOCUMENTS

| | | | |
|---|---|---|---|
| DE | 4240026 | C2 | 10/2003 |
| EP | 0322474 | A1 | 7/1989 |
| EP | 1408142 | A1 | 4/2004 |
| EP | 2508658 | A1 | 10/2012 |
| JP | S5698875 | U | 8/1981 |
| JP | S616320 | A | 1/1986 |
| WO | 9405837 | A1 | 3/1994 |
| WO | 2011138322 | A1 | 11/2011 |

OTHER PUBLICATIONS

German Language International Patentability Report in corresponding International Application No. PCT/EP2014/060979, dated Jun. 17, 2015, 17 pages; indicating novelty and inventive step for claims as amended via PCT Article 34.

* cited by examiner

CLOTHING WIRE FOR A ROLLER OF A CARDING MACHINE

CROSS REFERENCE TO RELATED APPLICATIONS

This patent application is the national phase of PCT/EP2014/060979 filed May 27, 2014, which claims the benefit of European Patent Application No. 13169340.0 filed May 27, 2013.

TECHNICAL FIELD

The invention relates to a clothing wire for a roller of a carding machine. The clothing wire is disposed to produce a so-called all-steel card clothing for a clothing roller.

BACKGROUND

Carding machines or scribblers are used to open (separate) or align, homogenize (in the production of fleece) and/or parallelize (in the production of yarns) fibers of a fiber material, for example, wool, cotton or even synthetic fibers or a fiber mixture. By means of the carding process it is possible to produce a fiber web from a fiber material. The fiber web consists of a loose structure of ordered individual fibers. For example, it is possible to produce a fleece from such a fiber web. The fiber web is formed during the carding process in that the fibers are taken up and combined by a large clothing roller referred to as the drum of the card with the aid of a removal means.

The carding machine may comprise different clothing rollers. Each clothing roller is provided with radially outward pointing teeth, serrations, tips or the like. The number and/or the size or the density of the teeth, serrations or tips, their shape and configuration may vary.

Usually, the clothing rollers are provided with all-steel card clothings. The latter consist of a profiled clothing wire that is wound under tension onto the respective clothing roller. The clothing wire has a base segment and a leaf segment. The base segment may have a rectangular or square cross-section, for example. The base segment extends away from the leaf segment, i.e., in operative position, approximately transversely relative to the generated surface of the clothing roller. A sawtooth profile is provided on the leaf segment in order to form the teeth or serrations. The clothing wire is wound around the generated surface of the clothing roller while being tensioned in longitudinal direction, and the two ends are fastened to the clothing roller.

The all-steel card clothing should display the longest possible useful life. It must not or only insignificantly damage the fibers and should allow an optimal homogenization or parallelization of the fibers during the production of the fiber web.

Clothing wires that have leaf segments provided with structures have been known from prior art.

For example, the clothing wire known from publication DE 40 38 352 A1 has a base segment and a leaf segment with a sawtooth profile. Both lateral surfaces of the leaf segment are provided with a profile. The profile may be convoluted or serrated. Also, a similar clothing wire is known from publication DE 42 40 026 C2.

Publication DE 39 40 714 A1 shows a clothing wire that has a non-symmetrical projection on the wire lateral surface in the region of the tooth base.

Publication EP 0 322 474 A1 introduces a clothing wire, wherein the tooth tips a laterally bent. However, there are no elevations on the tooth tips.

Publication EP 1 408 142 A1 describes a clothing wire with a base segment and a leaf segment having lateral surfaces potentially displaying differently configured profiles. For example, one lateral surface may have a convexly elevated profile, whereas the respectively other lateral surface is provided with a profile having concave recesses.

Referring to the clothing wire known from publication U.S. Pat. No. 3,391,429 A (or U.S. Pat. No. 6,185,789 B1), at least one lateral surface of the leaf segment—viewed in cross-section of the wire—is corrugated or serrated (or convoluted).

Publication WO 2011/138322 A1 describes a clothing wire, wherein the leaf segment may be configured with a flat lateral surface and with a profiled lateral surface. As the profile—viewed in cross-section—there are two semi-circular convex elevations on the lateral surface of the leaf segment.

Publication WO 94/05837 A1 (or JP 61006320 A) suggests the provision of a clothing wire having a surface that can be coated for increasing the friction (or for increasing the abrasion resistance and the corrosion resistance).

Publication EP 2 508 658 A shows a clothing wire, wherein it is not the lateral surfaces but the faces of the teeth that are structured by means of projections having a nose-like profile.

SUMMARY

Considering these known clothing wires, the object of the present invention may be viewed as being the provision of an improved clothing wire. In particular, an improved homogenization and parallelization of the fibers is to be achieved and their damage is to be reduced. The wear of the clothing wire is to be kept as minimal as possible.

The clothing wire extending in a wire longitudinal direction is particularly suitable for the takeup and working rollers of carding machines. The clothing wire has a base segment with a base surface that is disposed for being supported by the generated surface of the roller of a carding machine. Preferably, the base segment has either an approximately rectangular cross-section, or the cross-section of the base segment has—as is common in clothing wires with base segments wider than 0.8 mm—an elevation (e.g., triangular profile-shaped) on one side and a geometrically matching recess on the opposite side, as a result of which it is achieved that—in operative position—the elevations/recesses of the base segments of adjacent clothing wires come into engagement with each other and consequently mesh in a positive-locking manner.

A leaf segment extends away from the base segment approximately at a right angle relative to the base surface (i.e., approximately in a height direction perpendicular to the base surface of the base segment). The leaf segment has a first and a second (i.e., two) leaf segment lateral surfaces that are connected by a tooth face side on the side facing a way from the base segment. On their one side, the leaf segment lateral surfaces adjoin the base segment; on the side facing way from the base segment, the two leaf segment lateral surfaces are delimited by serratedly extending outside edges that are formed due to the contiguousness of respectively one of the leaf segment lateral surfaces with the tooth face. In so doing, the leaf segment is imparted with its serrated contour and forms teeth.

In order to produce this serrated contour recesses are provided, usually at regular distances, in the leaf segment of a tubular profile—preferably in the leaf segment lateral surfaces of the leaf segment of a tubular profile of which the clothing wire is made. The tubular profile may also be referred to as the blank or starting profile. The recesses begin at the end of the leaf segment that is opposite the base segment of the tubular profile. This end of the leaf segment that is opposite the base segment corresponds preferably to the point having the greatest height of the tubular profile of the leaf segment. On this end, the recesses are the largest or have the greatest expansion in longitudinal direction, as a rule. With decreasing height, i.e., with increasing distance from this end opposite the base segment and with the approach toward the base segment, the dimension or expansion of the recesses decreases in longitudinal direction. Preferably, the recess ends within the leaf segment. The dimension or expansion of the recesses in longitudinal direction becomes zero, before the end of the leaf segment lateral surfaces is reached. As a result of this, teeth are formed that are separated from one another by intermediate spaces formed by the recesses.

At least one projection exists on at least one of the two leaf segment lateral surfaces. The at least one projection has a dimension or extension in the direction of the width of the clothing wire (namely, in transverse direction or in the direction perpendicular to the wire longitudinal direction and perpendicular to the height direction) and extends in the wire longitudinal direction along the leaf segment lateral surface along the teeth, i.e., completely between two intermediate spaces or recesses delimiting one tooth in wire longitudinal direction.

In other words: The projection originally formed on the tubular profile would be continuous and, in order to create a delimitation relative to the projections on the clothing wire, would be referred to as tubular profile projection. Due to the intermediate spaces provided in the tubular profile, the leaf segment and hence also the tubular profile projection in the clothing wire are virtually always interrupted in a regular sequence. Consequently, there is no projection in the region of the intermediate spaces. Therefore, a projection is formed on each tooth of the clothing wire, said projection representing a segment of the tubular profile projection.

The projection surface of the projection provided on each tooth in a plane perpendicular to the longitudinal direction corresponds to the cross-sectional profile of the continuous tubular profile projection on the tubular profile, said tubular profile projection being interrupted by the recesses in the clothing wire and hence forming said projections.

Hereinafter, whenever reference is made to the cross-sectional profile of the projection, this is understood to mean the projection surface of the projection in the plane perpendicular to the longitudinal direction that corresponds to the cross-sectional profile of the tubular profile projection.

It is advantageous if the geometry of the cross-sectional profile of the projection or projection segments on the leaf lateral surfaces in wire longitudinal direction does not change, i.e., the projection surfaces of all the projections on the teeth are the same.

Consistent with the invention, the at least one projection is located on that half of the leaf segment lateral surface which is remote from or arranged at a distance from (in the "upper half", as it were) the base segment relative to the height direction. The at least one projection has an asymmetrical cross-sectional profile or an asymmetrical projection surface, i.e., the cross-sectional profile exhibits neither an axial nor a point symmetry. Preferably, the respective axis may be a vertical that is perpendicular to a flat segment of the respective leaf segment lateral surface and extends through the vertex of the respective projection.

It is particularly advantageous to embody the clothing wires in such a manner that a transition point between the leaf segment lateral surface and the projection is directly adjacent to the end opposite the base segment of the leaf segment lateral surface (adjacent the upper or free end, as it were). However, this transition point between the leaf segment lateral surface and the projection may also be arranged only in the immediate vicinity of this end, i.e., only at a distance of a few 1/10 mm—e.g., 1/10 mm to 1.0 mm—from said projection.

In a preferred embodiment the cross-sectional profile of the projection has a—preferably rounded—ridge from which extend a first flank and a second flank, each toward a transition point of the projection on the leaf segment lateral surface. The two overhang points are arranged in height direction on the opposite sides of the ridge in height direction. Therefore, each of the two flanks has extension components extending opposite the ridge, oriented away from the ridge. In contrast, the components of the transverse direction of the two flanks usually extend in the same direction (otherwise no projection would be formed).

The second flank is arranged closer to the base segment than the first flank. Therefore, the first flank is at a greater distance from the base segment. If—preferred—the first flank of the projection begins or ends directly on the upper end of the tooth, the end of the first flank facing away from the ridge coincides with the upper edge or outside edge of the associate leaf segment lateral surface.

To accomplish the inventive function of the clothing wire it is essential that the length of the second flank be shorter than the length of the first flank; the length of the second flank may amount to 10% to 20%, preferably 15% to 25%, of the total length of the projection, which corresponds to the sum of the lengths of the first and the second flanks. In so doing, it is achieved that, at least on average, the first flank is flatter than the second flank relative to the associate leaf segment lateral surface, i.e., the cross-sectional contour of the tubular profile projection or the projection surface of the projections arranged on each tooth extends in a plane perpendicular to the longitudinal direction in an approximately triangular or nose-shaped form.

As a result, the projection always has an asymmetrical cross-sectional profile, i.e., the cross-sectional profile displays neither an axial nor a point symmetry. In contrast, the cross-sectional profiles of the projections of so far used conventional clothing wires display at least an axial symmetry. Preferably, the respective axis could be a vertical that stands on a flat segment of the respective leaf segment lateral surface and extends through the vertex point of the respective projection.

The two flanks and, accordingly, also the entire projection are curved—at least in the region of the rounded ridge.

In order to be able to easily determine the length of the first flank, the second flank and the total length of the projection, in particular when the flanks are greatly bent, these lengths should always be determined as the projections on one of the two leaf segment lateral surfaces. If one of the leaf segment lateral surfaces extends, at least in some regions, in one plane, the lengths are related (projected) with respect to this plane. If both leaf segment lateral surfaces are flat in at least some regions, the reference/projection plane selected is that plane that is steeper relative to the base surface, i.e., exhibits the smaller angle of inclination relative to the height direction.

In most of the cases at least one of the leaf segment lateral surfaces will be virtually completely flat and be positioned perpendicularly to the base surface. The respective lengths then correspond to the lengths of the projections on at least one vertical lateral surface.

Preferably, the width of the clothing wire in the region of the highest point of the projection, i.e., at the point of the projection at which the clothing wire has the maximum width, corresponds to 20% to 50%, preferably 25% to 35%, of the width of the base segment.

As a result of the fact that the at least one projection is arranged on the at least one lateral surface of the clothing wire and due to its special geometry (nose shape) it is achieved that, during the carding process, the fibers can penetrate more easily in the clothing alleys formed by the inventive clothing wires (than in the case of card clothings that are produced with the use of conventional clothing wires with symmetrical projections) on the one hand, and the fibers that are already located in the card clothing alleys experience a greater retaining force on the other hand. Due to the increased retaining force, it is further prevented that—particular smooth (e.g., siliconized) fibers exit too soon from the card clothing alleys due to gravitational and/or centrifugal forces, i.e., an optional portion of the fibers will enter or exit in the respectively assigned region of the respective roller in the card clothing alleys.

The dwell times of the fibers in the card clothing alleys is critical in determining the parallelization and homogenization of the fibers during the carding process. Consequently, the material flow and the degree of efficacy of the carding process are improved by the use of the inventive clothing wire. The fibers are damaged less (frequently and strongly), and the wear of the clothing wire is reduced over a long time, which is advantageous, in particular when processing dulled fibers (e.g., with the use of titanium dioxide) that basically are the cause of strong wear.

Another advantage of projections arranged on the leaf segment lateral surfaces is their simple manufacture. In the manufacture of clothing wires that usually occurs by means of rollers, the projections can thus be formed during the rolling process without great expense.

If projections having a similar form (nose shape) were arranged on the front sides or the tooth breasts or on the rear sides of the teeth, they would have a completely different effect. Such projections arranged on the tooth breasts would only achieve that the fibers adhere better to the roller and would not fall as frequently off the underside of the roller. In contrast with the fibers that fall off, the fibers which do not fall off can still enter the card clothing alleys during the continued progress of the process where a parallelization/homogenization of the respective fibers is possible. In this case, an improvement of the parallelization/homogenization is achieved only indirectly, which is different from the clothing wire according to the invention. Consequently, the achievable process improvement is comparatively minimal.

In addition, it is disadvantageous that the production of such projections in prior art must usually take place by stamping (or by similar separating or cutting processes), which—in the case of the manufacture of clothing wires—involves considerable manufacturing expenses.

In order to ensure a gentle processing of the fibers the projection may be formed without offsets and edges, i.e., in addition to the ridge, also all the remaining transitions are rounded.

In a preferred embodiment the at least one projection is arranged only on the second leaf segment lateral surface; preferably, a projection is provided exactly there. However, it is also possible to arrange a projection on the first leaf segment lateral surface.

In principle, the leaf segment lateral surfaces may be bent as desired. However (for reasons of costs alone) it is intended that—in the regions in which there is no projection—the leaf segment lateral surfaces are flat, i.e., the first leaf segment lateral surface extends in the regions without projection in a first plane and the second leaf segment lateral surface—accordingly—in a second plane.

In a preferred embodiment the first flank, as well as the second flank, of the at least one projection have linear regions. In so doing, it is advantageous if the size of the angle included by the tangent of the linear region of the first flank and the first or second plane of the respective leaf segment lateral surface adjoining the at least one projection is smaller than the size of the angle included by the tangent of the linear region of the second flank and the respective plane.

However, it also conceivable that the flanks are not linear at any point, i.e., that they are completely rounded.

In one advantageous embodiment, the first leaf segment lateral surface is oriented at a right angle with respect to the base surface of the base segment, and the plane of the second leaf segment lateral surface is inclined with respect to the first leaf segment lateral surface by, e.g., approximately 8°, i.e., the second leaf segment lateral surface is at an angle of inclination of approximately 8°. If the teeth of the clothing wire—as is generally usual—are produced by stamping, the (semi-finished) clothing wire can be guided in an uncomplicated manner (lower production costs) because the first leaf segment lateral surface is arranged at a right angle with respect to the base surface.

Alternatively, it is possible for the first leaf segment lateral surface and the second leaf segment lateral surface to be inclined toward each other, in which case, e.g., the size of the angle included by the first leaf segment lateral surface and the base surface of the base segment and the size of the angle that is included by the second leaf segment lateral surface and the base surface are equal, i.e., the leaf segment lateral surface is inclined mirror-symmetrically (to the plane through the height and wire longitudinal direction). Especially if the base segment is also mirror-symmetrical in configuration, it should be possible to roll all these clothing wires in a less complicated manner.

In operative position, the card clothing alley is formed between two adjacent windings of the clothing wire wound on the generated surface of a wire roller and, in particular, between the two leaf segments of directly adjacent windings. Due to the at least one projection on at least one leaf segment lateral surface, the width of this card clothing alley reduced.

One lateral surface each is provided on the base segment on opposite sides adjacent the base surface. In so doing, the one lateral surface may transition—without steps and/or offsets and/or edges—into the first leaf segment lateral surface of the leaf segment. Preferably, an offset is formed between the other lateral surface and the second leaf segment lateral surface, said offset (in the bottom region) defining the width of the card clothing alley between two adjacent wire length segments or two adjacent leaf segments when the clothing wire is wound on the clothing roller.

In operative position, the lateral surfaces of the base segment act as contact surfaces. Two directly adjacent windings of the clothing wire are then in contact with each other along their associate lateral surfaces of their base segments.

Preferably, the clothing wire is manufactured by a rolling process. The teeth on the leaf segment can subsequently be formed by stamping or another separating process. The at least one projection on at least one leaf segment lateral surface is already produced during the rolling process.

BRIEF DESCRIPTION OF THE DRAWINGS

Advantageous embodiments of the invention can be inferred from the dependent patent claims, as well as from the description. The description is restricted to essential features of the invention. The drawings are to be used for supplementary reference. Hereinafter, exemplary embodiments of the invention are explained in greater detail with the use of drawings. They show in FIG. 1 a schematic view of a clothing roller with an all-steel card clothing;

DETAILED DESCRIPTION

Figure 1:
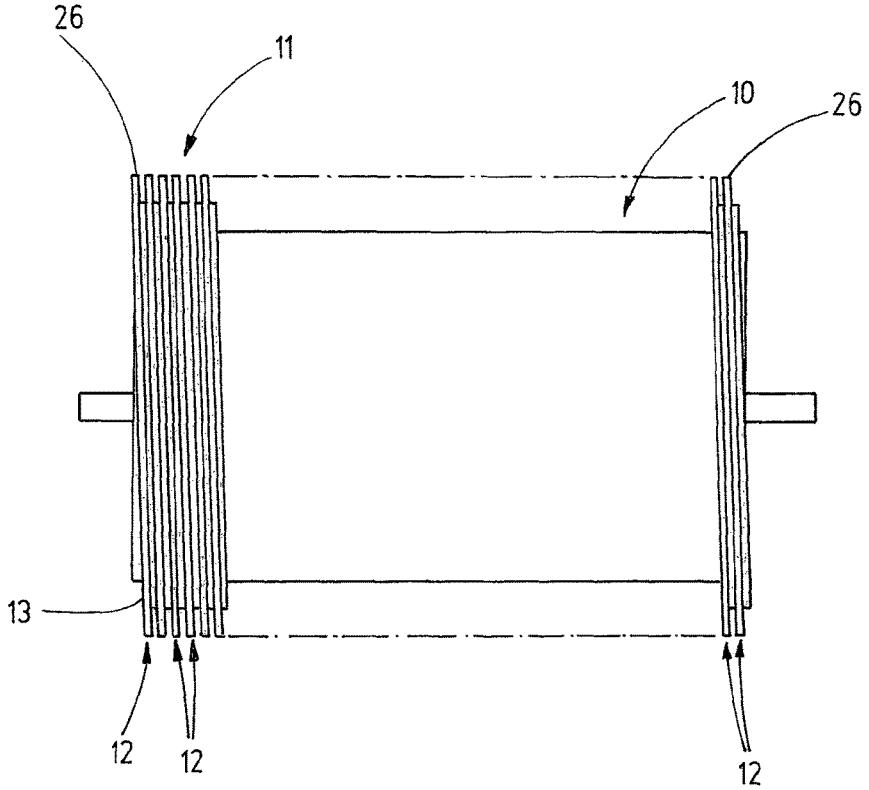

FIG. 1 is a schematic illustration of a clothing roller 10 with an all-steel card clothing 11 arranged thereon. The clothing roller 10 is part of a not specifically illustrated carding machine. The carding machine may comprise several clothing rollers 10.

The carding machine is disposed to produce a fiber web of loose fibers. The fibers in the fiber web are parallelized or homogenized by the carding machine. To accomplish this, the fibers are taken up by the all-steel card clothing on a clothing roller 10.

The all-steel card clothing 11 consists of a clothing wire 13 wound in several windings 12 on the generated surface of the clothing roller 10. The clothing wire 13 is—as it were—wound helically onto the wire roller 10 while being tensioned, as is schematically depicted in FIG. 1. The two loose ends of the clothing wire 13 are fastened to the clothing roller 10, for example by soldering, welding or another suitable connection that can be separated or not separated.

The configuration of the clothing wire 13 can be seen particularly well in FIGS. 2 to 9. The clothing wire 13 has a base segment 14 and a leaf segment 15. The base segment 14 and the leaf segment 15 are made in one piece without seams and joints from a cohesive material, for example metal, in particular steel. The cross-sectional form of the clothing wire 13 is produced in particular by means of a rolling process, wherein initially a tubular profile having a continuously constant cross-sectional profile in a wire longitudinal direction l is produced, said tubular profile then being processed further to produce the described form of the clothing wire 13.

The clothing wire 13 extends in a wire longitudinal direction l. At the base segment 14, the clothing wire 13 has a base surface 16. In its operative position, the base surface 16 of the clothing wire 13 is supported by the generated surface of the clothing roller 10. The leaf segment 15 extends approximately at a right angle relative to the base surface 16 away from the base segment 14, i.e., said leaf segment extends approximately in the height direction h that extends perpendicularly to the base surface 16.

Adjacent the base surface 16, the clothing wire 13 has a first lateral surface 14*a* and a second lateral surface 14*b* on its base segment 14. In the exemplary embodiment, a first leaf segment lateral surface 15*a* of the leaf segment 15 adjoins the first lateral surface 14*a* of the base segment 14 without steps, offsets and edges. In one exemplary embodiment (FIGS. 3, 4*b*, 5, 7 and 9), the first lateral surface 14*a* and the first leaf segment lateral surface 15*a* extend in a first plane $E_1$ at a right angle with respect to the base surface 16, which, among other things, also implies advantages in view of manufacturing technology.

The base segment 14 is adjoined by a second leaf segment lateral surface 15*b* of the leaf segment 15 on the side opposite the first leaf segment lateral surface 15*a*. The second leaf segment lateral surface 15*b* extends at least into a center segment 17 in a second plane $E_2$. The second plane $E_2$ is inclined with respect to the first plane $E_1$ and includes—with the latter—an acute angle. As a result of this, the width of the leaf segment 15 decreases in the center segment 17 of the leaf segment 15 in a direction away from the base segment 14.

The center segment 17 of the second leaf segment lateral surface 15*b* is offset relative to the second lateral surface 14*b* of the base segment 14, transversely with respect to the wire longitudinal direction l, as a result of which an offset 18 having an offset surface 19 is formed in the transition region between the base segment 14 and the leaf segment 15. The offset surface 19 faces away from the base surface 16 and may be oriented so as to be parallel to the base surface 16 or be oriented slightly inclined relative to the base surface 16.

Figure 4A:
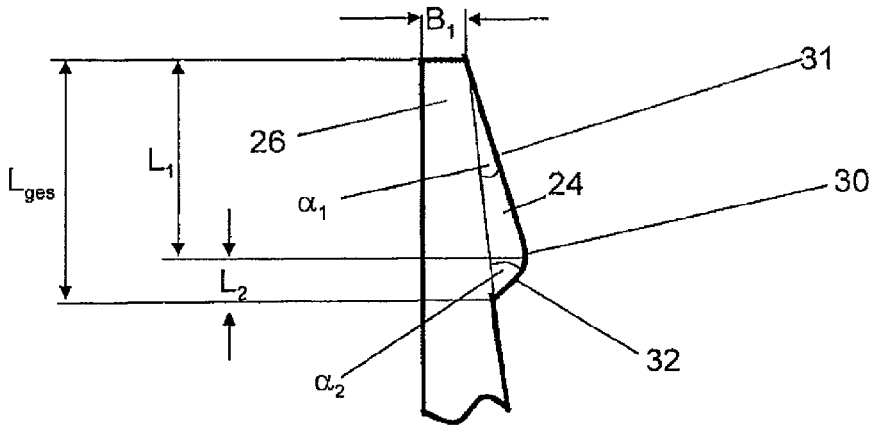
FIG. 4*a* the dimensions of the exemplary embodiment of the clothing wire, cross-sectional representation as in FIG. 3.

In the region of the free end of the leaf segment 15 remote from the base segment 14 and adjoining the center section 17, there is a projection 24 on the second leaf segment lateral surface 15*b*, said projection being depicted enlarged in FIG. 4*a*. In the exemplary embodiment, the leaf segment 15 of the clothing wire 13 has, in cross-section, only a single projection 24 and is in particular free of recesses or additional profiles.

Figure 5:
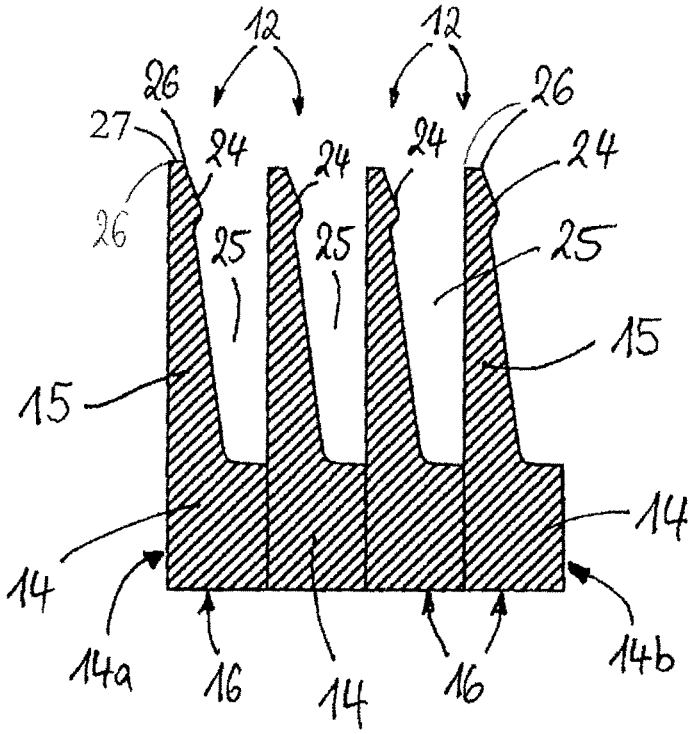
FIG. 5 a schematic representation of the arrangement of several adjacent windings of the clothing wire according to the exemplary embodiment of FIGS. 2 to 4.
Figure 6:
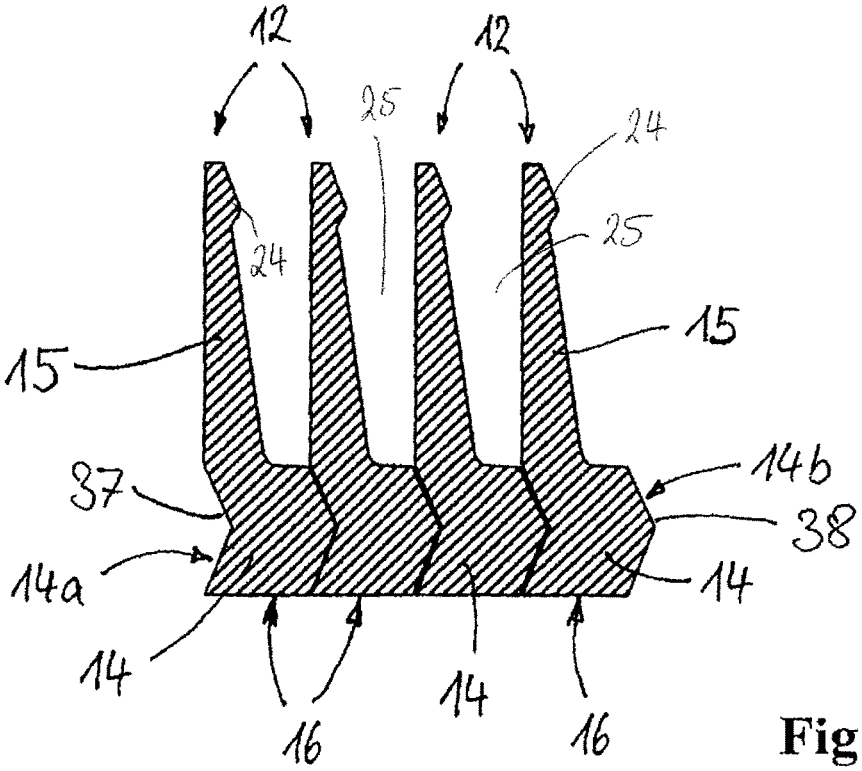
FIG. 6 a schematic representation of several adjacent windings of a modified exemplary embodiment of a clothing wire.

The function of this projection 24 can be inferred from the schematics of FIGS. 5 and 6. If the clothing wire 13 is wound to form an all-steel card clothing 11 on the clothing roller 10, a card clothing alley 25 is formed between two directly adjacent windings 12 of the clothing wire 13. The card clothing alley 25 is formed between the leaf segments 15 of directly adjacent windings 12. In this card clothing alley 25, the fibers are taken up and parallelized to produce the fiber web. The projection 24 ensures that the fibers can be taken up in the card clothing alley 25 without being damaged and also be retained in the card clothing alley 25.

Figure 2:
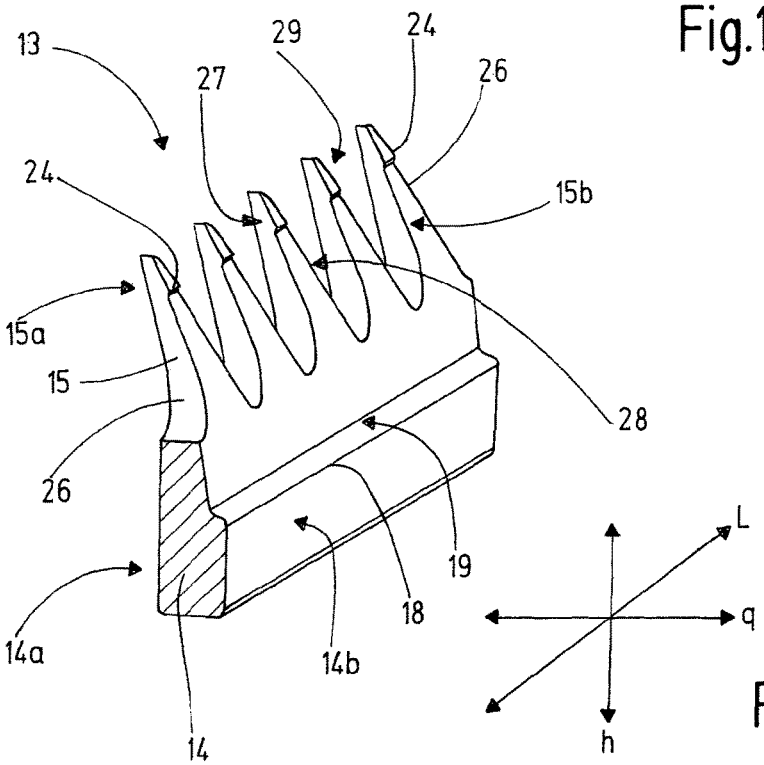
FIG. 2 a perspective representation of a section of an exemplary embodiment of an inventive clothing wire.
Figure 3:
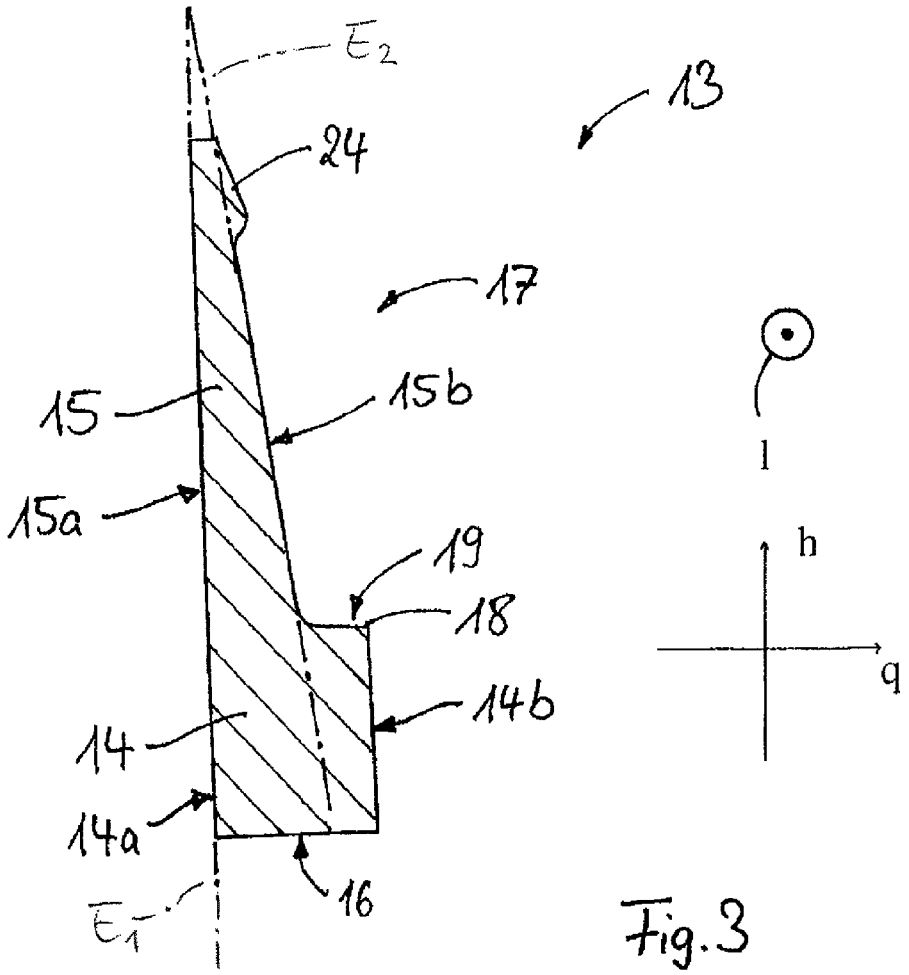
FIG. 3 the cross-section along the plane extending in h and q through the blank wire (wire before imparting the teeth) used for the exemplary embodiment of the clothing wire of FIG. 2.

The leaf segment 15 has two outside edges 26 that are formed by the contiguousness of respectively one leaf segment lateral surface 15*a*, 15*b* and the tooth face side 27. The outside edges 26 are serrated opposite the base surface 16 or the base segment 14, so that, as a result of this, teeth 28 are formed on the leaf segment 15. The teeth 28 are shown in FIG. 2. In the exemplary embodiment, the outside edges 26 are overall serrated. An intermediate space 29 exists between respectively two teeth 28 in wire longitudinal direction l.

Respectively one projection 24 is provided on each tooth 28 on the second leaf segment lateral surface 15*b*. In the production of the clothing wire 13, a blank profile having a tubular profile projection that is continuous in wire longitudinal direction l is initially produced. Subsequently, the outside edges 26 are produced, in which case, for the formation of the teeth 28, intermediate spaces 29 are formed by stamping or another separating process. As a result of this, a projection 24 is formed on each tooth 28, in which case the projections 24 are at a distance from each other due to the intermediate spaces 29 in wire longitudinal direction l. Each projection 24 extends upward in transverse direction q—extending perpendicularly to the wire longitudinal direction l as well as in height direction h—from the associate second leaf segment lateral surface 15*b*. The shapes of the projections 24 on each tooth 28 are identical. Each projection 24 has a projection surface projected in a plane perpendicular to the wire longitudinal direction l, said projection surface corresponding to the cross-sectional surface of the tubular profile projection on the original tubular profile. This projection surface is referred to as the cross-sectional profile P and corresponds to the contour of a cross-section of the projection 24 in a cross-sectional plane that extends completely outside the intermediate spaces 29 perpendicular to the wire longitudinal direction l.

In accordance with the invention the projection 24 has an asymmetrical cross-sectional profile P. The projection 24 has a ridge 30. On the ridge 30, the projection 24 is at the greatest distance from the second plane $E_2$ in which extends the center segment 17 of the second leaf segment lateral surface 15*b*. Starting from the ridge 30, the projection 24 has a first flank 31 and a second flank 32 that extend—starting from the ridge 30—in opposite directions relative to the height direction h. The second flank 32 is closer to the base segment 14 than the first flank 31.

The first flank 31 and the second plane $E_2$ include a first angle of inclination $\alpha_1$. Accordingly, the second flank 32 and the second plane $E_2$ include a second angle of inclination $\alpha_2$. The size of the second angle of inclination $\alpha_2$ is greater than the size of the first angle of inclination $\alpha_1$. Viewed along the second plane $E_2$ toward the base segment 14, the slope of the projection 34 increases gradually along the first flank 31 up to the ridge 30 and then decreases more steeply from the ridge 30 to the center segment 17 along the second flank 32.

In other words: The first length $L_1$ of the projection 24 along the first flank 31 up to the ridge 30 is greater than the second length $L_2$ of the projection 24 along the second flank 32 from the center segment 17 to the ridge 30. In so doing, the two lengths $L_1$, $L_2$ are measured as projections in a common reference plane, for example in the first plane $E_1$ or the second plane $E_2$. In accordance with the example, the lengths measured along the first plane are d, h. The lengths $L_1$, $L_2$ and also the total length $L_{ges}$ of the projection 24 are defined as the projections on a common plane and, in accordance with the example, the first plane $E_1$. Instead of the first and/or second plane $E_2$ it would be possible, for measuring the length of these measured lengths and/or the determination of the angles of inclination, to also use another reference plane that is oriented at a right angle relative to the base surface 16, for example.

Due to this, the cross-sectional profile P of the projection 24 has the shape of a nose, as it were, that slopes upward more gradually via a first flank 31 relative to a reference plane (for example, the second plane $E_2$) than via the other, second flank 32.

The second length $L_2$ of the projection 24 along the second flank 32 is 15% to 25% of the total length $L_{ges}$ (sum of the first length $L_1$ and the second length $L_2$) of the projection 24 along the first flank 31. The length $L_{ges}$ is smaller than 1.5 mm. These dimensions relate to the length measurement along the first plane $E_1$ (see FIG. 4*a*).

Figure 4B:
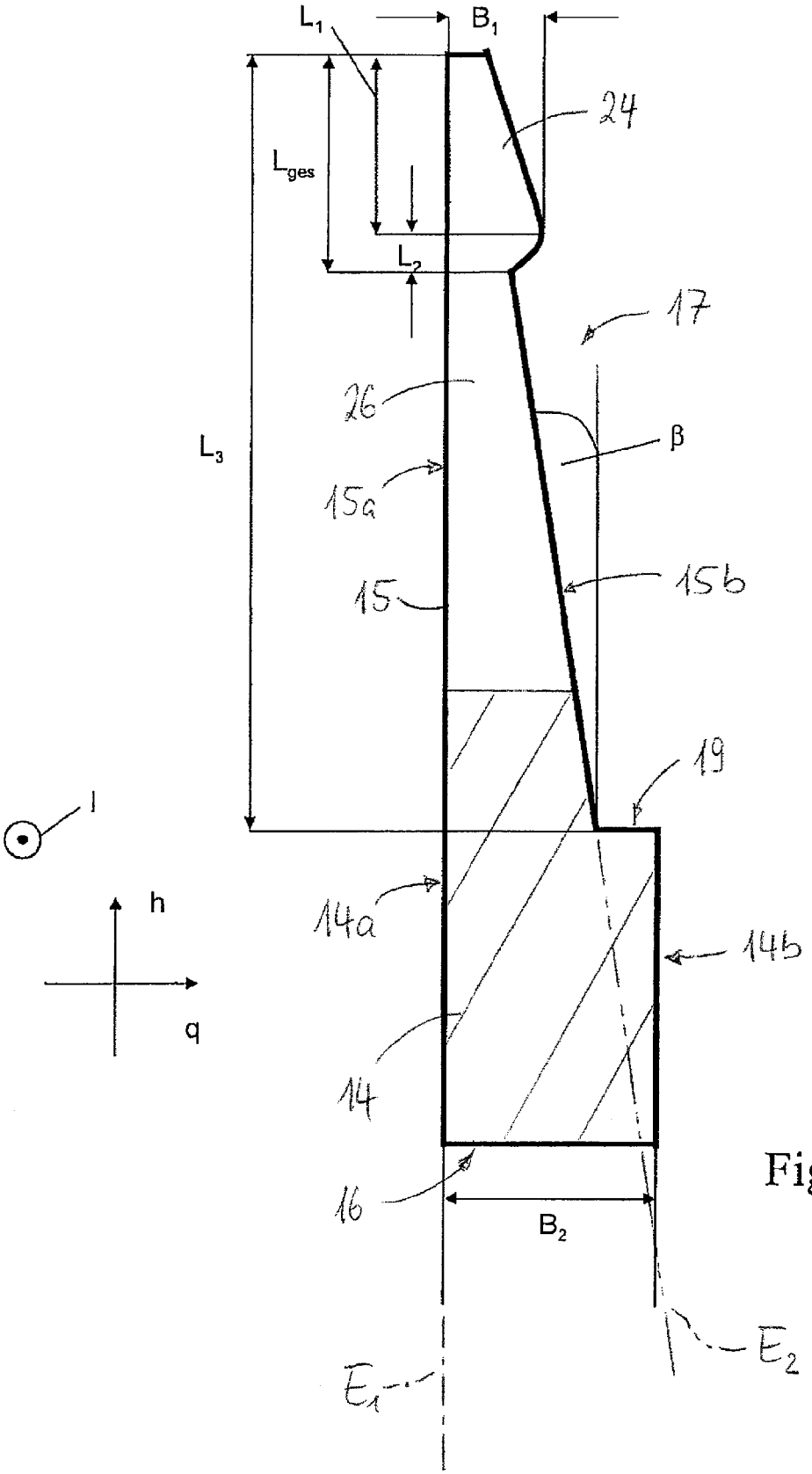
FIG. 4*b* a partial representation of the clothing wire in cross-section in the region of the projection.

In accordance with the dimensional marks (dimensioning) shown in FIG. 4*b*, the total length $L_{ges}$ of the projection 24 amounts to 25% to 35% of the total length $L_3$ of the leaf segment 15. The maximum width $B_1$ in transverse direction q in the region of the projection 24 that is (approximately) on the height of the ridge 30 is 25% to 35% the width $B_2$ of the base segment 14 in transverse direction q. The total height of the clothing wire 13 in height direction h, in accordance with the example, is 4 to 5 mm and, preferably, at most 3.5 to 6 mm. The angle of inclination β relating to the vertical relative to the base surface of the second plane $E_2$ is approximately 4 to 12°, in particular 7 to 9°, and, in accordance with the example, approximately 8°. The angle of inclination β of the first plane $E_1$ being perpendicular to the base surface 16 in the exemplary embodiment is, accordingly, 0°.

The end of the first flank 31 remote from the ridge 31 coincides with the outside edge 26 of the second leaf segment lateral surface 15*b*, i.e., the first flank 31 starts and ends, respectively, with the outside edge 26.

FIG. 6 illustrates a modified exemplary embodiment of the inventive clothing wire 13. In so doing, the leaf segment 15 is unchanged, so that reference may be made to the previous example. Different from the exemplary embodiments of FIGS. 1 to 5, the lateral surfaces 14*a*, 14*b* of the base segment 14 are modified. The first lateral surface 14*a* has a recess 37 and the respectively other, second lateral surface 14*b* has an elevation 38 adapted to the recess 37. The elevation 38 of a winding 12 can thus engage in the recess 37 of a directly adjacent winding 12, as is schematically illustrated in FIG. 6. In the former exemplary embodiment, the two lateral surfaces 14*a*, 14*b* are oriented parallel to each other and at a right angle with respect to the base surface 16, so that the lateral surfaces 14*a*, 14*b* of directly adjacent windings 12 are in planar contact with each other (FIG. 5).

Figure 7:
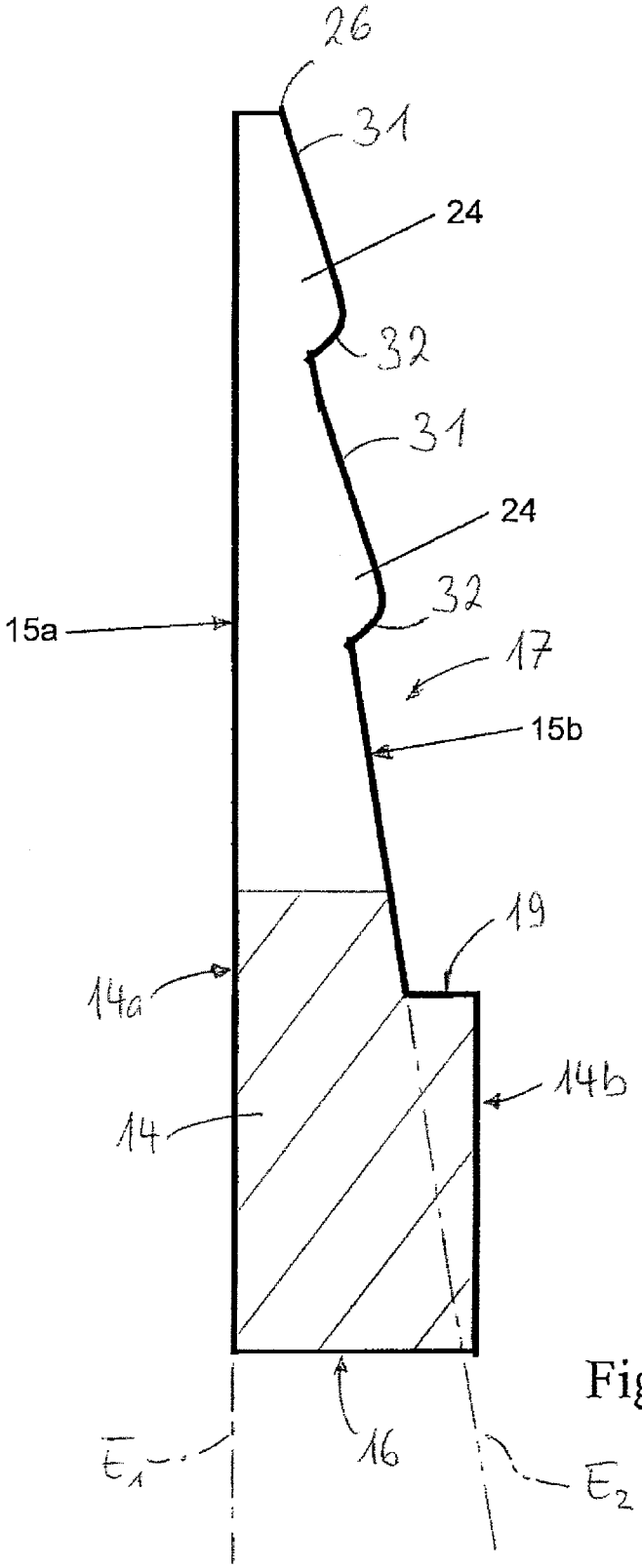
FIG. 7 a cross-sectional representation of the clothing wire with two projections on the second leaf segment lateral surface.
Figure 8:
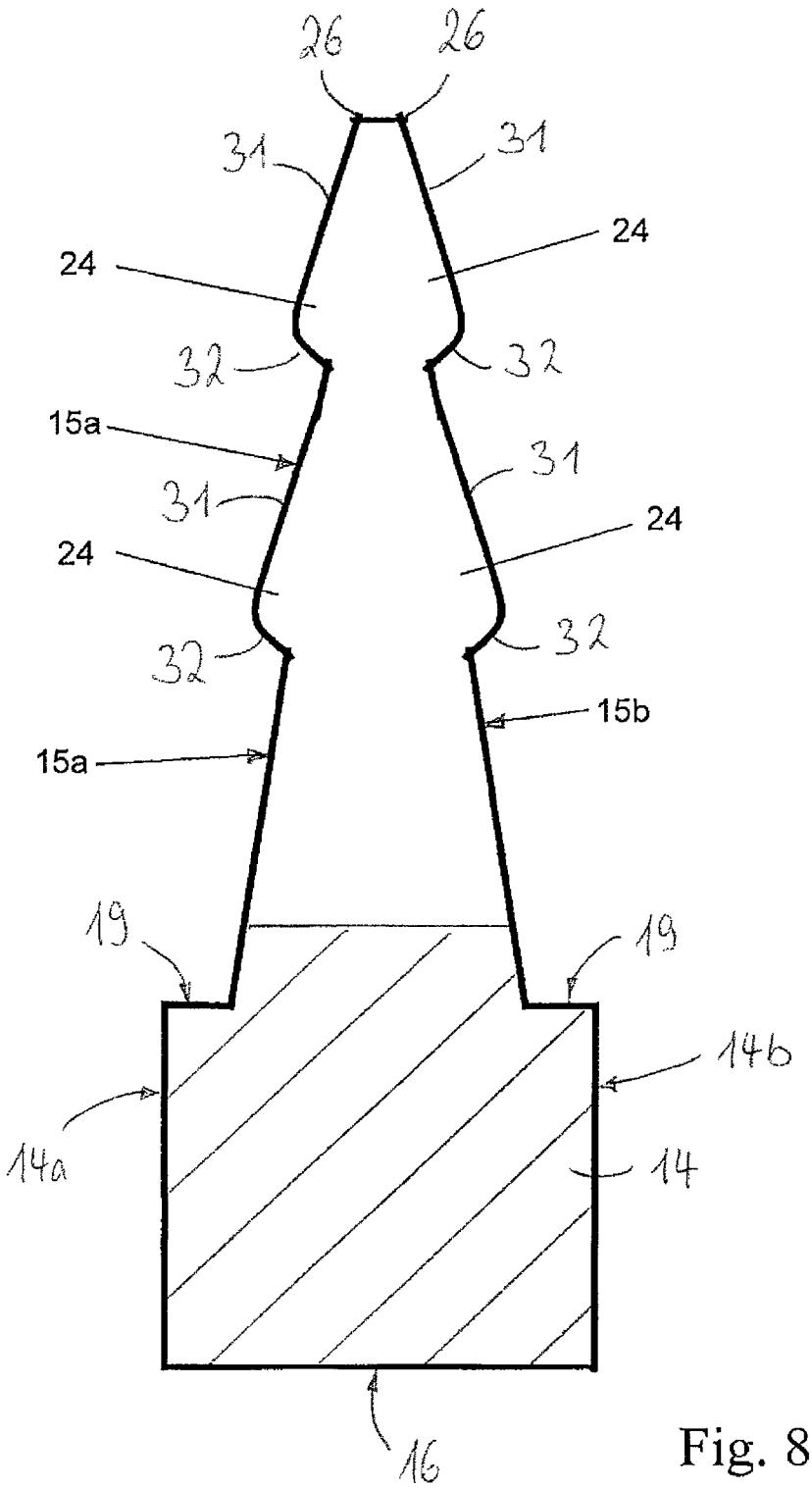
FIG. 8 a cross-sectional representation with two projections, respectively, on the first and the second leaf segment lateral surfaces of the clothing wire.
Figure 9:
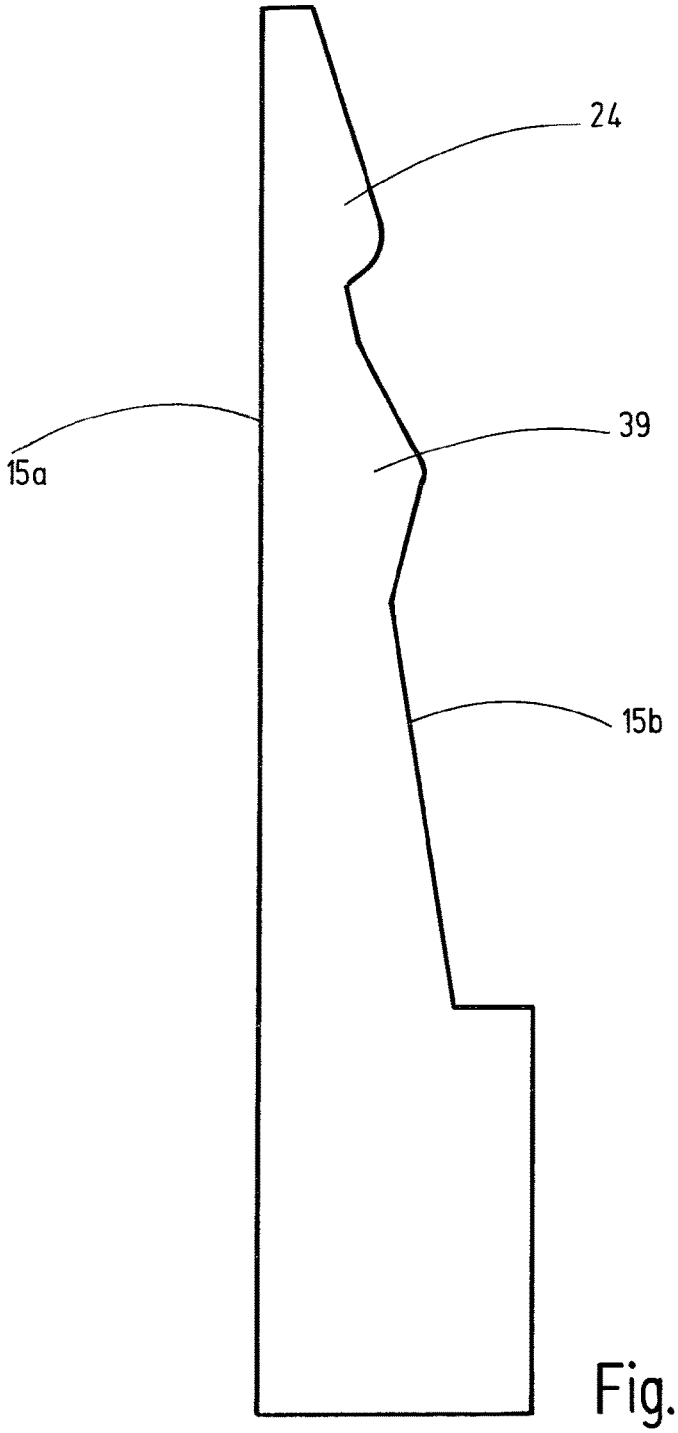
FIG. 9 a cross-sectional representation of the clothing wire with respectively one asymmetrical and one symmetrical projection on the second leaf segment lateral surface.

Each of the FIGS. 7, 8 and 9 shows an exemplary embodiment of a clothing wire 13 that has several and, in accordance with the example, two asymmetrical projections 24 on at least one of the two leaf segment lateral surfaces 15*a*, 15*b*—in accordance with the example of the second leaf segment lateral surface 15*b*—or two asymmetrical projections on the first leaf segment lateral surface 15*a*, as well as on the second leaf segment lateral surface 15*b*. Regarding the shape and the arrangement of the projection 24 adjoining the free end of a tooth 28, reference is made to the description hereinabove. Both projections 24 may have the same shape, wherein the first flank 32 of the one projection 24 that is arranged closer to the base segment 14 is arranged directly next to or at a distance from the second flank 32 of the respectively other projection 24.

In the embodiment of FIG. 9, the additional projection has a symmetrical cross-sectional profile P and may be referred to as the symmetrical projection 39. The symmetrical projection 39 is arranged on the second leaf segment lateral surface 15*b*. It should also be mentioned that even three, four or more projections—optionally on one leaf segment lateral surface 15*a*, 15*b*—feature advantages, considering all the embodiments of the invention.

The exemplary embodiment depicted by FIG. 2, different from the embodiments of FIGS. 3, 4 to 7 and 9, does not have a leaf segment lateral surface 15*a*, 15*b* arranged rectangularly with respect to the base surface 16. Both leaf segment lateral surfaces 15*a*, 15*b* and consequently the teeth 28 are inclined relative to a plane oriented at a right angle with respect to the transverse direction q. Due to the inclination, the projections 24 are located above the first lateral surface 14*a* of the base segment 14. The first plane $E_1$ or a reference plane, in which extends the first lateral surface 14*a*, or which—in case of an uneven first lateral surface 14*a*—extends in several contact points at a distance in height direction h tangentially with respect to the first lateral surface 14*a*, intersects the projection 24 in accordance with the example.

LIST OF REFERENCE SIGNS

10 Clothing roller
11 All-steel card clothing
12 Winding
13 Clothing wire
14 Base segment
14*a* First lateral surface
14*b* Second lateral surface
15 Leaf segment
15*a* First leaf segment lateral surface
15*b* Second leaf segment lateral surface
16 Base surface
17 Center segment
18 Offset
19 Offset surface
24 Asymmetrical projection
25 Card clothing alley
26 Outside edge
27 Tooth face side
28 Tooth
29 Intermediate space
30 Ridge
31 First flank
32 Second flank
37 Recess
38 Elevation
39 Symmetrical projection
$\alpha_1$ First angle of inclination
$\alpha_2$ Second angle of inclination
$\beta$ Angle of inclination
l Wire longitudinal direction
h Height direction
q Transverse direction
$E_1$ First plane
$E_2$ Second plane
$L_1$ Length of the first flank
$L_2$ Length of the second flank
$L_{ges}$ Total length of projection
$L_3$ Total length of leaf segment
$B_1$ Maximum width in the region of the at least one projection
$B_2$ Width of the base segment
H Height of the elevation
P Cross-sectional profile

The invention claimed is:

1. A clothing wire (13) extending in a wire longitudinal direction (1) for a clothing roller (10) of a carding machine, the clothing wire comprising:

a base portion (14) with a base surface (16) configured for being supported by the clothing roller (10);

a flat leaf portion (15) extending away from the base portion (14) in a height direction (h) perpendicular to the base surface (16);

wherein the leaf portion (15) has, on a side facing away from the base portion (14), outside edges (26) that extend serratedly so as to form teeth (28) thereon, and wherein the leaf portion (15) has a first leaf portion lateral surface (15*a*) and a second leaf portion lateral surface (15*b*), each extending from the base portion (14) up to the associated outside edge (26); and wherein, on at least one of the leaf portion lateral surfaces (15*a*, 15*b*), at least one projection (24) is formed rising in a transverse direction (q) which extends perpendicularly to the height direction (h) and to the wire longitudinal direction (1), said projection also extending along the wire longitudinal direction (1), wherein the at least one projection (24) is located on an upper half of the at least one leaf portion lateral surface (15*a*, 15*b*) spaced from the base portion (14) in the height direction (h), wherein the at least one projection (24) has an asymmetrical cross-sectional profile;

wherein the cross-sectional profile of the at least one projection (24) has a rounded ridge (30), from which ridge extends a first flank (31) along the height direction (h) away from the base portion (14), and a second flank (32) that extends toward the base portion (14), wherein the second flank (32) is arranged closer to the base portion (14) than the first flank (31), and a length ($L_1$) of the first flank (31) is greater than a length ($L_2$) of the second flank (32).

2. The clothing wire as in claim 1, wherein the at least one projection (24) is located on an upper third of the at least one leaf portion lateral surface (15*a*, 15*b*) spaced from the base portion, in the height direction (h).

3. The clothing wire as in claim 1, wherein the length ($L_2$) of the second flank (32) is between 10% to 30% of a total length ($L_{ges}$) of the at least one projection (24).

4. The clothing wire as in claim 3, wherein the length ($L_2$) of the second flank (32) is between 15% to 25% of the total length ($L_{ges}$) of the at least one projection (24).

5. The clothing wire as in claim 1, wherein a maximum width ($B_1$) of the clothing wire (13) in the transverse direction (q) at the at least one projection (24) is between 20% to 50% of a width ($B_2$) of the base portion (14) of the clothing wire (13).

6. The clothing wire as in claim 5, wherein, near the at least one projection, the maximum width ($B_1$) of the clothing wire is between 25% to 35% of the width ($B_2$) of the base portion (14) of the clothing wire (13).

7. The clothing wire as in claim 1, wherein a total length ($L_{ges}$) of the at least one projection (24) is between 20% to 40% of a total length ($L_3$) of the leaf portion (15) in the height direction (h).

8. The clothing wire as in claim 7, wherein the total length ($L_{ges}$) of the at least one projection (24) is between 25% to 35% of the total length ($L_3$) of the leaf portion (15) in the height direction (h).

9. The clothing wire as in claim 1, wherein the at least one projection (24) is formed so as to be without offsets and edges.

10. The clothing wire as in claim 1, wherein the at least one projection (24) is arranged only on the second leaf portion lateral surface (15*b*).

11. The clothing wire as in claim 1, wherein exactly one projection (24) is arranged on at least one of the leaf portion lateral surfaces (15*a*, 15*b*).

12. The clothing wire as in claim 1, wherein the first leaf portion lateral surface (15*a*) extends in a plane ($E_1$) in regions without the at least one projection (24), and the second leaf portion lateral surface (15*b*) extends in a plane ($E_2$) in regions without the at least one projection (24).

13. The clothing wire as in claim 12, wherein both the first flank (31) and the second flank (32) of the at least one projection (24) have linear regions, wherein an angle ($\alpha_1$) defined by a tangent of the linear region of the first flank (31) and the respective plane ($E_1$, $E_2$) adjoining the at least one projection (24) is smaller than an angle ($\alpha_2$) defined by a tangent of the linear region of the second flank (32) and the respective plane ($E_1$, $E_2$) adjoining the at least one projection (24).

14. The clothing wire as in claim 1, wherein a plane ($E_1$) in which the first leaf portion lateral surface (15*a*) extends is oriented at a right angle with respect to the base surface (16) of the base segment (14), and a plane ($E_2$) in which the second leaf portion lateral surface (15*b*) extends is inclined with respect to the first leaf portion lateral surface (15*a*).

15. The clothing wire as in claim 1, wherein a first plane ($E_1$) in which the first leaf portion lateral surface (15*a*) extends and a second plane ($E_2$) in which the second leaf portion lateral surface (15*b*) extends are inclined toward each other, wherein a size of an angle included by the first plane ($E_1$) and the base surface (16) of the base portion (14) and an angle included by the second plane ($E_2$) and the base surface (16) have the same size.

16. Clothing wire as in claim 15, wherein the plane ($E_1$) of the first leaf segment lateral surface (15*a*) and the plane ($E_2$) of the second leaf segment lateral surface (15*b*) are inclined toward each other, wherein the size of the angle included by the plane ($E_1$) and the base surface (16) of the base segment (14) and the angle included by the plane ($E_2$) and the base surface (16) have the same size.

* * * * *